US006192612B1

(12) United States Patent
Maier et al.

(10) Patent No.: US 6,192,612 B1
(45) Date of Patent: Feb. 27, 2001

(54) PROPULSION DEVICE

(75) Inventors: Timothy J. Maier, Arlington, VA (US); Gregory J. Maier, Potomac, MD (US)

(73) Assignee: Oblon, Spivak, McClelland, Maier & Neustadt, P.C., Arlington, VA (US)

( * ) Notice: Subject to any disclaimer, the term of this patent is extended or adjusted under 35 U.S.C. 154(b) by 0 days.

(21) Appl. No.: 09/235,340

(22) Filed: Jan. 22, 1999

Related U.S. Application Data

(60) Provisional application No. 60/076,672, filed on Mar. 2, 1998.

(51) Int. Cl.[7] ..... F41C 3/06; F41F 1/00; F41A 21/00

(52) U.S. Cl. ..... 42/55; 42/54; 89/7; 89/14.6; 89/14.4

(58) Field of Search ..... 42/54, 55; 89/14.6, 89/7, 14.4

(56) References Cited

U.S. PATENT DOCUMENTS

| | | | | |
|---|---|---|---|---|
| 1,352,715 | | 9/1920 | Wily . | |
| 1,504,819 | * | 8/1924 | Hanwell | 45/55 |
| 1,624,086 | * | 4/1927 | Wily | 42/54 |
| 1,998,023 | | 4/1935 | Peake | 42/55 |
| 1,999,357 | | 4/1935 | Driggs, Jr. | 42/55 |
| 2,000,607 | | 5/1935 | Peake | 42/55 |
| 2,046,663 | * | 7/1936 | Wade | 42/55 |
| 2,129,042 | * | 9/1938 | Anthony | 42/54 |
| 2,324,860 | * | 7/1943 | Mannigel | 42/55 |
| 2,754,607 | | 7/1956 | Wily | 42/55 |
| 3,022,597 | * | 2/1962 | Rucker | 42/55 |
| 3,049,828 | * | 8/1962 | Mills | 42/54 |
| 3,050,893 | * | 8/1962 | Maddux | 42/55 |
| 3,400,661 | * | 9/1968 | Coon et al. | 89/14.6 |
| 3,412,497 | * | 11/1968 | Denton et al. | 42/54 |
| 3,472,218 | * | 10/1969 | Mers | 42/54 |
| 3,648,395 | * | 3/1972 | Nathanson | 42/54 |
| 3,710,675 | | 1/1973 | Asikainen | 89/41 |
| 3,745,691 | | 7/1973 | Brown, Jr. | 42/55 |
| 3,745,879 | | 7/1973 | Asikainen et al. | 89/37 |
| 3,760,684 | | 9/1973 | LaSpisa et al. | 89/37 |
| 3,774,585 | | 11/1973 | Boyd | 124/21 |
| 3,782,243 | | 1/1974 | Ziegler | 89/87 |
| 3,938,272 | | 2/1976 | Ditto et al. | 42/55 |
| 4,059,820 | | 11/1977 | Turpening | 340/15.5 |
| 4,222,307 | | 9/1980 | Roettges et al. | 89/87 |
| 4,369,592 | | 1/1983 | Perry | 42/54 |
| 4,869,151 | * | 9/1989 | Chahin | 89/14.4 |
| 4,941,390 | * | 7/1990 | Bulman | 89/7 |
| 4,967,638 | * | 11/1990 | Bulman | 89/7 |
| 5,079,987 | * | 1/1992 | Pate et al. | 89/7 |
| 5,149,907 | * | 9/1992 | Thiesen | 89/7 |
| 5,180,878 | | 1/1993 | Denchfield | 89/7 |
| 5,531,150 | | 7/1996 | Gegaregian et al. | 89/15 |

OTHER PUBLICATIONS

BTCKYTRD BTLLIS ICS, Backyard Ballistics Home Page, pp. 1–4 http://www2.csn.net/%7Ebsimon/backyard.html, Sep. 9, 1998.

PO T O BTZOOKT, Hair Spray Spud Gun, Home Page, pp. 1–3 http://www2.csn.net%7Ebsimon/hspray.htm, Sep. 9, 1998.

* cited by examiner

*Primary Examiner*—Charles T. Jordan
*Assistant Examiner*—Glenda L. Sánchez
(74) *Attorney, Agent, or Firm*—Oblon, Spivak, McClelland, Maier & Neustadt, P.C.

(57) ABSTRACT

A propulsion device including a fuel chamber and barrel constructed with off-the-shelf parts for propelling biodegradable objects. The fuel chamber includes a fuel nozzle actuator for receiving fuel from a pressurized gaseous container. The fuel chamber also includes an ignitor for igniting the fuel in the fuel chamber. The barrel may be interchanged with one including noise reducing holes.

33 Claims, 5 Drawing Sheets

PROPULSION DEVICE

CROSS-REFERENCE

This application claims the benefit of U.S. Provisional Application No. 60/076,672, filed on Mar. 2, 1998, which is incorporated in its entirety.

BACKGROUND OF THE INVENTION

1. Field of the Invention

The present invention is directed to a propulsion device for propelling an object. More particularly, the present invention is directed to a propulsion device manufactured using off-the-shelf parts for propelling biodegradable objects.

2. Discussion of the Background

A propulsion device generally includes a fuel chamber connected to a barrel having a longitudinal bore and an ignition system for igniting fuel contained in the fuel chamber. These devices may propel objects with live ammunition or alternatively objects without ammunition. In addition, there exist toy cannons and firework propulsion devices used for entertainment purposes, as well as other propelling devices used for simulating an actual cannon.

For example, FIGS. 6–8 of U.S. Pat. No. 4,369,592 disclose a conventional propulsion device used to propel a ball or compressible object. The propulsion device includes a loading chamber, a firing chamber, and a loading mechanism. To operate this device, a firecracker is first placed and ignited in the loading chamber. Then, the loading mechanism is laterally slid backwards and the ignited firecracker drops into the firing chamber, explodes and propels the compressible object.

A problem with this conventional propulsion device is that it is difficult and very dangerous to load. That is, the firecracker must first be lit and then the loading mechanism must manually be retracted. Thus, there is a great likelihood that the firecracker will prematurely explode and injure the operator of the device. Another problem with this device is that firecrackers are illegal in most states. Therefore, the legal use of this device is greatly restricted.

A simpler propulsion device, which uses lighter fluid as an explosive material, is shown in FIG. 8 of U.S. Pat. No. 3,745,691. This device includes a hollow tube having two rigid disks disposed at one end of the tube. Each of the disks has a small central opening. To operate this device, lighter fluid is squirted into a space between the disks through one of the central openings. The tube is then shaken several times to distribute the lighter fluid and to allow at least part of it to vaporize. The device may then be ignited using a lighted match.

Although this device is simpler to manufacture and operate than that previously discussed, the same problem exists in that the device is very dangerous to use. That is, the lighter fluid may burst into flames and injure the person igniting the device.

Another problem with conventional propulsion devices is that the propelled object is usually a rubber ball or a metal object. After ejection of the object, it must be retrieved to prevent unwanted littering. Also, conventional devices are generally limited to firing objects having a predetermined diameter which precisely fit into the bore of the firing barrel. This greatly limits the types of objects that may be propelled. Additionally, a ball or metal object that may be fired does not provide a tight seal and a proper lubrication to the inside of the bore for optimum firing range and consistency.

A general problem with conventional propulsion devices is in the type of fuel used. Many devices use either a liquid fuel (e.g., lighter fluid), firecrackers, or solid carbide pellets dissolved in water to create a combustible mixture. One problem with using a liquid fuel is it must first be partially vaporized. Therefore, the propulsion device must be shaken to vaporize part of the liquid fuel, which adds an additional step in the firing process. The problem with using carbide pellets dissolved in water is that during the explosion, the excess water may be sprayed throughout the device. Thus, the device must be cleaned on a regular basis. Further, the above fuels do not create a uniform combustible mixture, and thus a uniform and highly reliable detonation is difficult to obtain.

Yet another problem with conventional propulsion devices is that the fueling process is inconvenient and cumbersome. For example, many devices require fuel to be first injected into the fuel chamber, and then the fuel chamber is sealed. Thus, the fueling process requires an excessive number of steps in order to create a combustible mixture.

Consequently, there is a need for a novel propulsion device which is simple and inexpensive to manufacture by using off-the-shelf parts, one which is easy to fuel, and one which is safe to operate. There is also a need for a propulsion device which uses a gaseous fuel that is consistent and uniform in mixture and which is easily dispensed into the device. It is also desirable to have a propulsion device that is capable of and suitable for propelling biodegradable products, which after propelling would not need to be retrieved. Further, a propulsion device with a beveled end capable of cutting into and propelling parts of objects having an irregular shape is needed. Additionally, there is a need for a device with interchangeable bores some fitted with noise reducing holes that allow the gas to expand slightly before exiting the bore producing a firing with reduced noise.

SUMMARY OF THE INVENTION

Accordingly, one object of the present invention is to provide a propulsion device which is simple yet versatile, durable, silent, and safe to operate.

Yet another object of the present invention is to provide a propulsion device which is easily manufactured using off-the-shelf parts, and which is fueled by cheap, convenient and readily available combustible fuel.

Another object of the present invention is to provide a propulsion device which is simple to fuel using a pressurized fuel canister.

Still another object of the present invention is to provide a propulsion device which cuts and propels biodegradable objects and other objects having an irregular shape.

These and other objects are accomplished by providing a propulsion device which includes a fuel chamber connected to a barrel having an interchangeable longitudinal bore. The longitudinal bore includes a beveled end and gas expansion silencing holes. The fuel chamber includes a fuel nozzle actuator to activate a fuel nozzle of a fuel canister, thereby dispensing fuel into the fuel chamber. In addition, the fuel chamber includes either a pull-type ignition device or a remotely activated ignition device.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
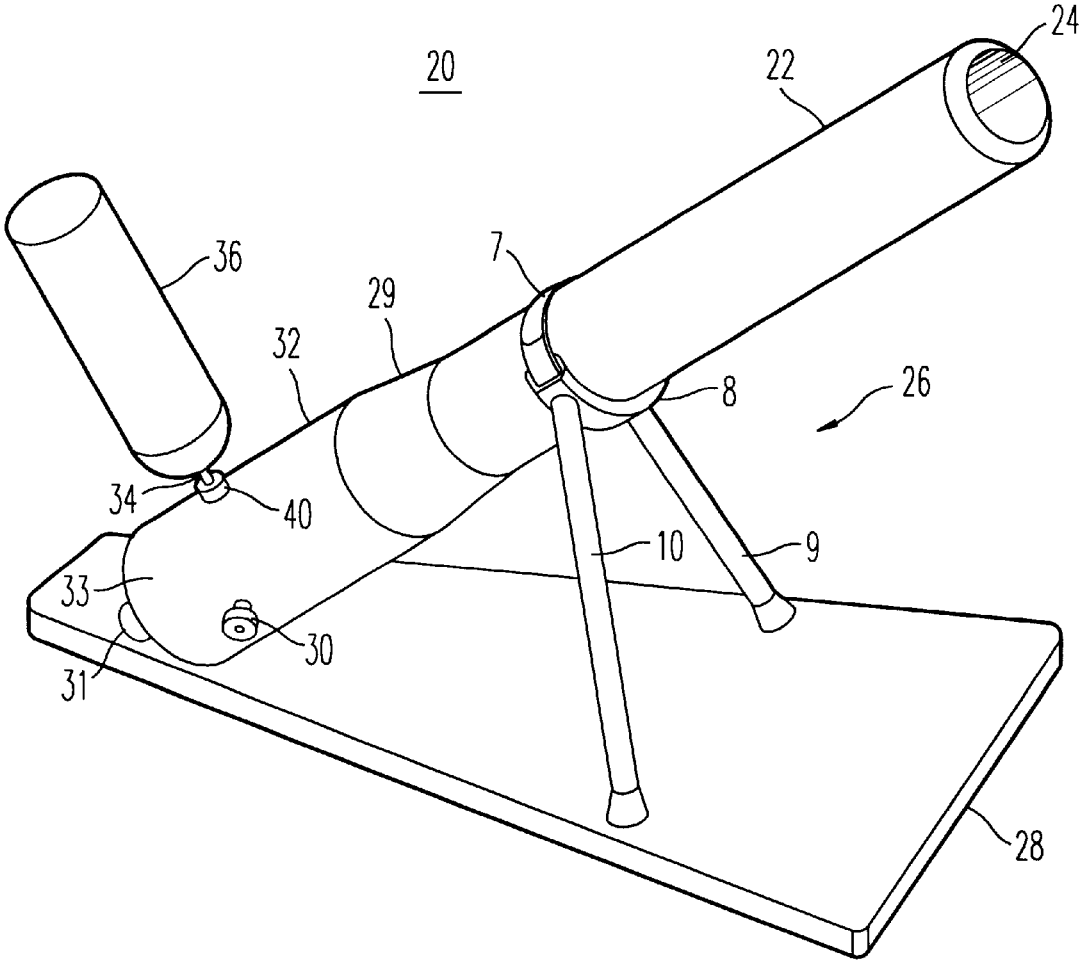
FIG. 1 is a perspective view of a propulsion device according to the present invention.

Referring now to the drawings, wherein like reference numerals designate identical or corresponding parts throughout the several views, and more particularly to FIG. 1 thereof, there is illustrated a propulsion device 20 including a barrel 22 having a longitudinal bore 24. The barrel 22 is connected to a reducer 29 which is connected to a fuel chamber 32 by a primer and appropriate epoxy. Alternatively, the barrel 22 may be attached to the fuel chamber 32 by a threaded coupler (not shown). The fuel chamber 32 includes a fuel nozzle actuator 40 for actuating a fuel nozzle 34 of a fuel canister 36 to dispense fuel into the fuel chamber 32. The fuel chamber 32 also includes an ignitor 30 for igniting fuel dispensed into the fuel chamber 32. The fuel chamber 32 further includes a threaded end cap 31 which is connected by a female threaded trap clean-out 33 attached to the fuel chamber 32 by the appropriate epoxy.

In addition, the barrel 22 may be elevated by an adjustable support 26 and a platform 28. The platform 28 is preferably a lightweight easily transportable platform constructed of plywood, preferably about a half inch thick. The adjustable support 26 includes two adjustable leg supports 9 and 10, a rubber u-coupler 8 and an adjustable strap 7 that can be tightened around the barrel 22. The propulsion device 20 may rest on top or be secured to the platform 28 by straps and the platform 28 may be secured to the ground by stakes (not shown). Alternatively, the adjustable support may be, for example, the one disclosed in U.S. Pat. No. 5,531,150, which is herein included by reference.

The barrel 22 and fuel chamber 32 may be made with standard Poly Vinyl Chloride (PVC) pipe. Alternatively, the barrel 22 and fuel chamber 32 may be made with Acrylonitrile Butadiene Styrene (ABS) pipe, metal pipe, etc. ABS pipe is preferred because it is relatively inexpensive, flexible, strong, and easy to work with. ABS piping is better suited for combustion type devices because it is more flexible and reacts less adversely to extreme hot and cold temperatures. If it does break, it will simply fracture and not shatter. ABS is more expensive and slightly lighter than PVC, but provides a substantially safer material to make such a propulsion device. PVC, though easier to find, is more brittle than ABS, however, for lower order propellants (i.e., hair spray) both PVC and ABS are suitable materials. A standard diameter of 3–6 inches is recommended for the fuel chamber 32 and 6-1.5 inches for the barrel 22. However, the diameter may be increased as needed to propel an object having a larger diameter, such as a pumpkin. The length of barrel 22 is widely variable. A length as short as 1 foot may be used for reduced weight and ease of transport. However, a barrel length of 10 feet or more may be selected to improve a firing range of the device.

The fuel contained in the fuel canister 36 is preferably conventional and commercially available hair spray, but ignitor fluid, methanol, white gas (camping fuel), propane, gasoline vapor, WD40 spray, starting fluid (ether), and any other combustible product may be used. Hair spray is the preferred fuel because it cheap, readily available and both simple and convenient to use. An unscented variety is preferred. Unlike liquid fuel, the gaseous hair spray completely fills the combustion chamber to produce a uniform and highly reliable detonation. Furthermore, WD40 dispensed from a spray bottle produces the same highly reliable detonation while burning cleanly and not producing a sticky residue. A readily available and inexpensive hair spray, such as one sold under the trademark WHITE RAIN, REVLON or AQUA NET may be used. The standard ingredients of such conventional hair spray generally include SD alcohol 40, water, isobutane or butane, propane, va/crotonates/vinyl neodecanoate copolymer, aminomethyl propanol, ammonium hydroxide, and ammonium benzoate.

Figure 2:
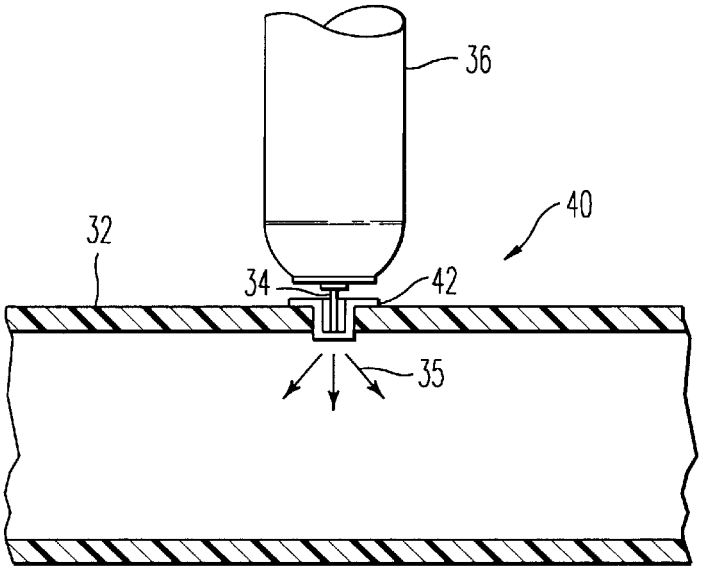
FIG. 2 is a vertical cross-section of a portion of the device illustrated in FIG. 1, showing fuel being loaded into the device.

A description of how the fuel 35 is injected into the fuel chamber 32 will now be given with reference to FIG. 2. First, a fuel spray cap (not shown) is removed from the fuel nozzle 34 of the fuel canister 36. This may be easily performed by pulling on the fuel spray cap in a direction away from the fuel canister 36. Next, the fuel nozzle 34 is inserted in the fuel nozzle actuator 40. The fuel nozzle actuator 40 then activates the fuel nozzle 34 of the fuel canister 36 to dispense the fuel 35 into the fuel chamber 32. That is, when the fuel nozzle 34 is pressed against, for example, a mesh material 42 covering the fuel port 41, the fuel nozzle 34 is pressed inwards and the fuel 35 contained in the fuel canister 36 is injected into the fuel chamber 32. The fuel nozzle actuator 40 shown in FIG. 2 includes the fuel port 41 covered by a fine mesh material 42. After the fuel 35 (e.g., hair spray, WD40) is propelled into the fuel chamber 32, the fuel 35 mixes with air within the fuel chamber 32, and thus a uniform gaseous combustible mixture is created.

The advantages of the fuel nozzle actuator 40 are numerous. For example, the fuel nozzle actuator 40 allows the fuel 35 to be directly injected into the fuel chamber 32 with little or no waste. In addition, the fuel 35 may be dispensed into the fuel chamber 32 in one simple step. Further, because the fuel canister 36 is a compressed or pressurized aerosol spray, the fuel 35 is quickly injected into the fuel chamber 32 and uniformly dispensed and mixed with air.

Figure 3A:
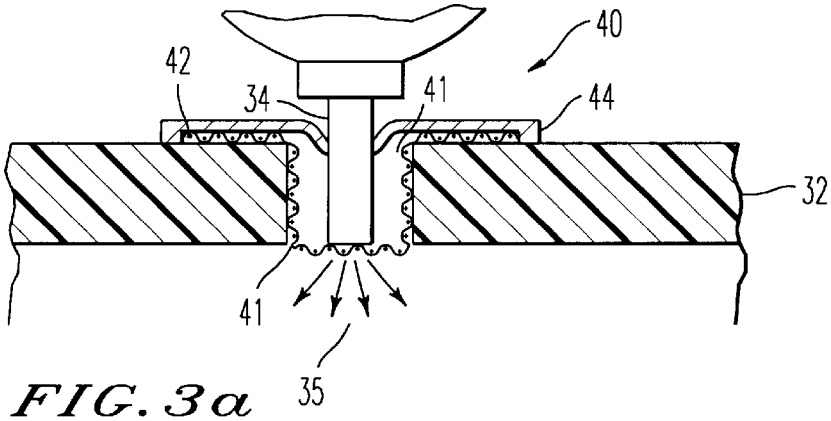
FIG. 3*a* is a fragmentary cross-section of a first embodiment of a fuel nozzle actuator of the device illustrated in FIG. 1.

FIG. 3*a* is a detailed view of a first embodiment of a fuel nozzle actuator 40. As shown, the fuel nozzle actuator 40 includes a mesh material 42 covering the fuel inlet 41 and a fuel retainer 44 which is penetrable by the fuel nozzle 34. The fuel retainer 44 is preferably made with a self-sealing material, such as a soft rubber or plastic. The fuel retainer 44 prevents the fuel 35 which was injected into the fuel chamber 32 from escaping back through the fuel inlet 41. The fuel retainer 44 also prevents the fuel 35 from spraying back toward or onto the operator when the fuel 35 is injected into the fuel chamber 32. Alternatively, the fuel retainer 44 may be a detached element, such as a plastic plug or cork, which is inserted into the fuel inlet 41 after the fuel 35 is injected into the fuel chamber 32.

The mesh material 42 may be comprised of, for example, fine mesh wire, nylon, a fiber material sold under the trademark KEVLAR, cotton cloth, or other material which is permeable by gaseous or liquid fuels. The mesh wire is preferably fine mesh wire having a mesh count of approximately 15×15. However, a finer mesh wire having a mesh count of 90×90may be used. A mesh count is defined as the number of mesh apertures contained in a lineal inch. Alternatively, a standard household window screen may be used as the mesh material 42. The mesh material 42 should be a sufficient size to cover and partially overlap the fuel inlet 41. The mesh material 42 may be secured to the fuel chamber 32 with a conventional epoxy resin of sufficient strength and quality to resist the force of the fuel nozzle 34 being pressed against it. The advantages of using a fine mesh wire or screen material are that it is inexpensive, readily available, and more durable than, for example, cotton cloth. In addition, fine mesh wire is more permeable than that of cotton cloth. The advantage of KEVLAR is that it is highly durable, however, KEVLAR is more expensive than mesh wire. Cotton cloth is also advantageous because it is readily available and easy to use. However, cotton cloth may need to be replaced more frequently than that of fine mesh wire or KEVLAR.

Figure 3B:
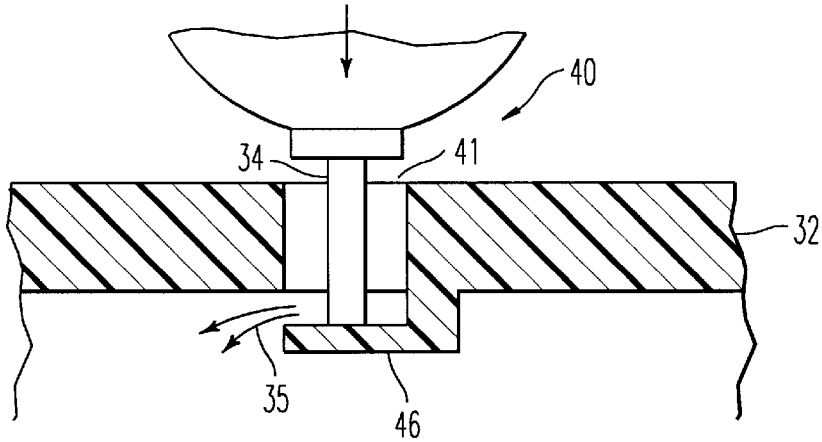
FIG. 3*b* is a fragmentary cross-section of a second embodiment of a fuel nozzle actuator of the device illustrated in FIG. 1.

FIG. 3*b* is a detailed view of a second embodiment of a fuel nozzle actuator 40. As shown, the fuel nozzle actuator 40 includes an L-shaped rigid member 46 disposed below and covering the fuel inlet 41. The L-shaped rigid member 46 is secured to an inner surface of the fuel chamber 32. When the fuel nozzle 34 is pressed against the L-shaped rigid member 46, the pressurized gaseous fuel 35 is propelled into and completely fills the fuel chamber 32.

Figure 3C:
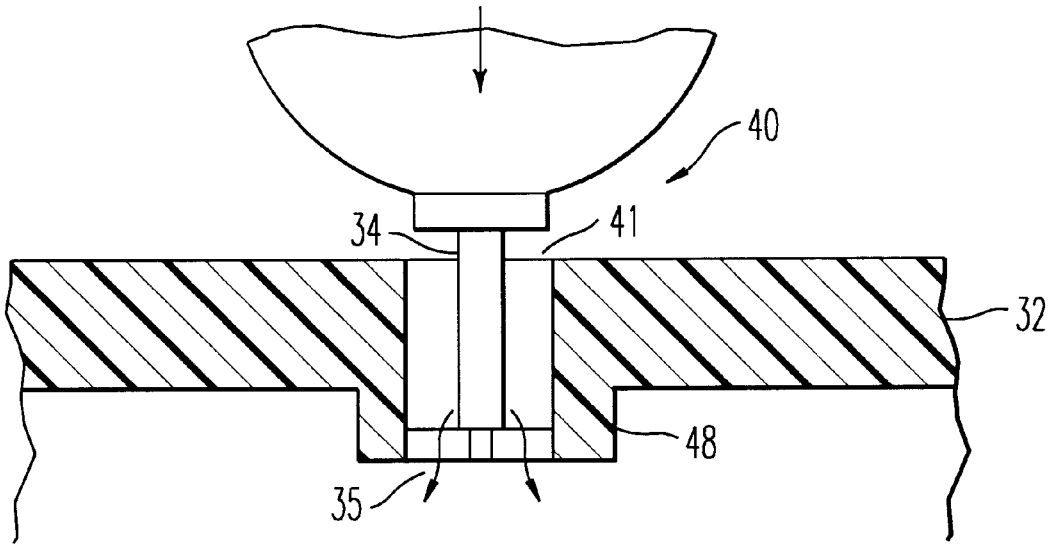
FIG. 3*c* is a fragmentary cross-section of a third embodiment of a fuel nozzle actuator of the device illustrated in FIG. 1.

Alternatively, FIG. 3*c* shows a third embodiment of fuel nozzle actuator 40 in which the L-shaped rigid member 46 of the second embodiment may be replaced with a U-shaped rigid member 48. The operation of injecting the fuel 35 into the fuel chamber 32 is similar to that of the second embodiment. An advantage of the U-shaped member 48 is that it provides greater support for the fuel nozzle 34 to be pressed against.

The rigid members 46 and 48 shown in FIGS. 3*b* and 3*c*, respectively, are preferably made with PVC or ABS material. However, another material which will adhere to the fuel chamber 32 may be used. In addition, the rigid members 46 and 48 are preferably secured in place by use of a primer and the appropriate ABS or PVC epoxy resin to resist the explosive force from numerous firings of the device.

Figure 3D:
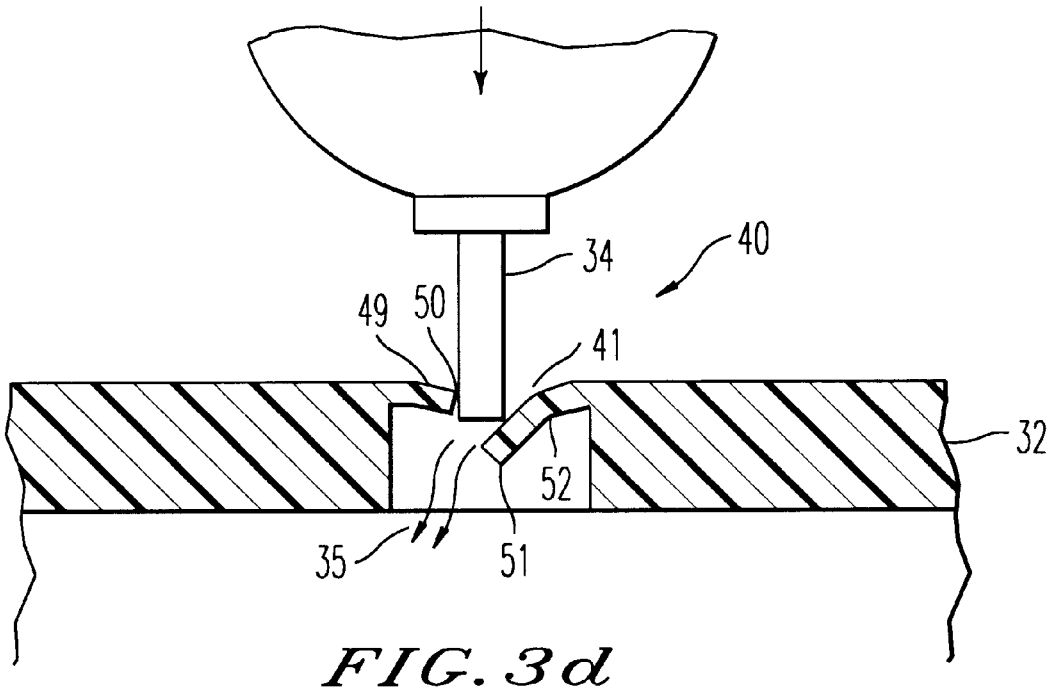
FIG. 3*d* is a fragmentary cross-section of a fourth embodiment of a fuel nozzle actuator of the device illustrated in FIG. 1.

FIG. 3*d* is a detailed view of a fourth embodiment of a fuel nozzle actuator 40. As shown, the fuel nozzle actuator 40 includes hinged members 49 and 52 which bridge the fuel inlet 41. The contact ends 50 and 51 of the hinged members 49 and 52, respectively, contact each other and are in a closed position (not shown) when the fuel nozzle 34 is not inserted into the fuel inlet 41. However, as shown, when the fuel nozzle 34 is pressed against the hinged member 52, the contact end 51 is urged downwards and exerts an upward force on the fuel nozzle 34. Thus, the fuel nozzle 34 is actuated (i.e., pressed inwards) causing the fuel 35 to be injected into the fuel chamber 32. After the fuel nozzle 34 is extracted from the fuel nozzle actuator 40, the hinged member 52 returns to the closed position. Therefore, the fuel 35 injected into the fuel chamber 32 is prevented from escaping through the fuel inlet 41. FIG. 3*d* illustrates only the hinged member 52 actuating the fuel nozzle 34, however, the hinged member 49 may be used as well. The hinged members 49 and 52 may be comprised of, for example, metal or plastic. Alternatively, the hinged members 49 and 52 may be constructed with a hard rubber material which has a natural tendency to return to a closed position after being pressed inwards.

In each of the FIGS. 3*a*–3*d*, the fuel inlet 41 may include the fuel retainer 44 (as shown in FIG. 3*a*), or alternatively the fuel inlet 41 may be made an appropriate size such that the fuel nozzle 34 fits snugly into the fuel inlet 41.

Figure 4A:
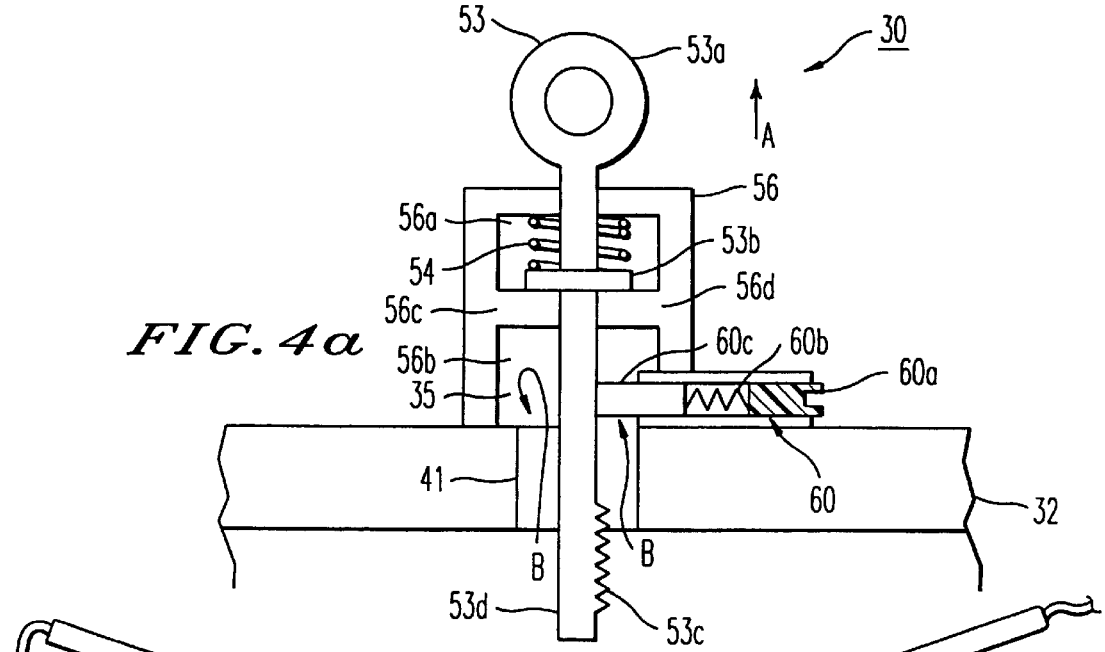
FIG. 4*a* is a fragmentary cross-section of a pull-type ignition device used to ignite the device illustrated in FIG. 1.

FIG. 4*a* illustrates a pull-type ignitor 30 which may be used to ignite the device 20. The ignitor 30 includes a trigger 53 contained in a ignition housing 56. The ignition housing 56 includes an upper portion 56*a* and a lower ignition chamber 56*b*. The trigger 53 includes a trigger handle 53*a* connected to a trigger shaft 53*d*. The trigger shaft 53*d* extends through the ignition housing 56 into the ignition port 41. The trigger 53 also includes a trigger actuator 53*b* contained within the upper portion 56*a* of the ignition housing 56 and connected perpendicularly to the trigger shaft 53*d*. The trigger actuator 53*b* is urged by a trigger spring 54 against housing members 56*c* and 56*d* which are disposed between the upper portion 56*a* and the ignition chamber 56*b* of the ignition housing 56. In addition, the trigger 53 has a striker 53*c* on a lower portion of the trigger shaft 53*d*.

The ignitor 30 also includes a sparker assembly 60 containing a sparker 60*c*, a sparker spring 60*b*, and a removable end piece 60*a*. The sparker 60*c* is urged by the sparker spring 60*b* towards the trigger shaft 53*d*. The sparker 60*c* may be flint or any other material which cause sparks to form when contacted by the striker 53*c*. In addition, the sparker 60*c* may be replaced by removing the end piece 60*a* and the sparker spring 60*b* and then inserting a new sparker 60*c*. The sparker assembly 60 is preferably secured to an outer surface of the fuel chamber 32, but may also be secured to an inner surface of the fuel chamber 32. Further, as shown, the sparker assembly 60 is disposed near an edge of the ignition port 41 so that the sparker 60*c* will contact the striker 53*c* when the trigger 53 is actuated. The sparker assembly 60 is preferably secured to the fuel chamber 32 using a conventional epoxy resin of sufficient strength and quality to resist numerous actuations of the trigger 53.

A description of the operation of ignitor 30 shown in FIG. 4*a* will now be given. As shown, the ignitor 30 is maintained in a safety state in which the striker 53*c* does not contact the sparker 60*c*. However, when the trigger handle 53*a* is moved in a direction indicated by the arrow A, the striker 53*c* will contact the sparker 60*c*. Thus, a spark is created in the ignition chamber 56*b* which ignites the fuel 35 contained in the ignition chamber 56*b*. The fuel 35 enters the ignition chamber 56*b* from the fuel chamber 32 through the ignition port 41 (shown by the arrow B). In addition, because an ignition occurs in the ignition chamber 56*b*, an ignition will also simultaneously occur in the fuel chamber 32. The device 20 is preferably ignited by attaching a ignition line (not shown) to the trigger handle 53*a* and remotely activating the trigger 53 in the direction of the arrow A. Thus, an operator is able to remotely activate the device 20 at a safe distance.

Figure 4B:
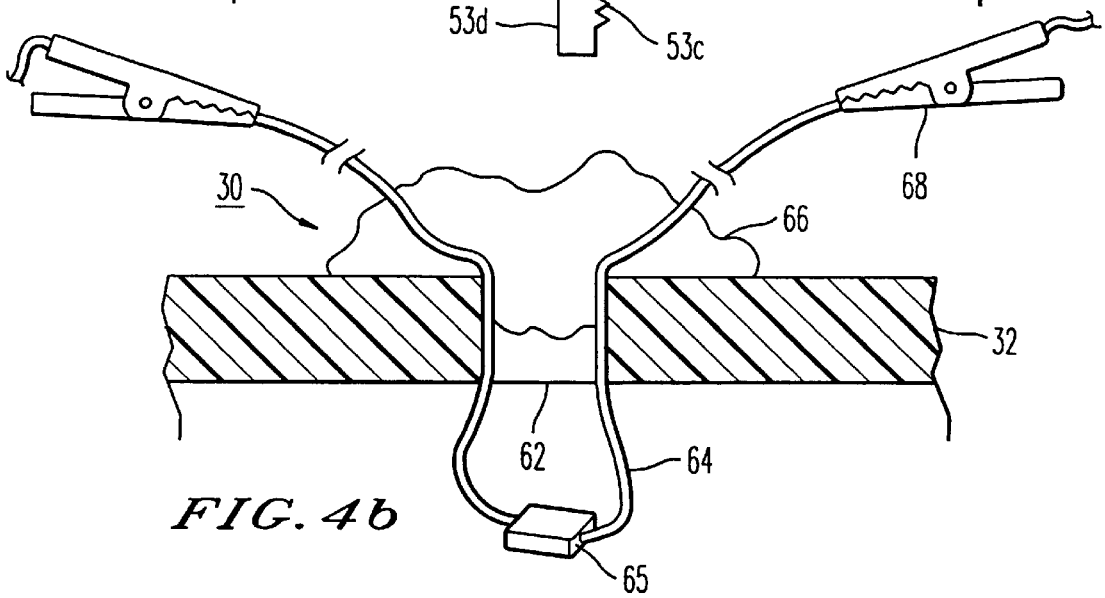
FIG. 4*b* is a fragmentary cross-section of a remote ignition device used to ignite the device illustrated in FIG. 1.

FIG. 4*b* shows another ignition device 30 which allows the propulsion device 20 to be remotely ignited. The ignitor 30 shown in FIG. 4*b* includes an electrical ignition wire 64 which is secured into the ignition port 62. The ignition wire 64 includes an ignition material 65 disposed at a U-shaped portion of the ignition wire 64 so that the ignition material 65 is inside of the fuel chamber 32. Also included is a securing material 66 which secures the ignition wire 64 in the ignition port 62. The ignition wire 64 is connected to ignition wire clips 68 (e.g., alligator clips) which are used to connect the ends of the ignition wire 64 to a remote activation device (not shown). The securing material 66 may be a soft clay material, putty, sponge, etc. As shown, the securing material 66 prevents the ignition wire 64 from contacting the fuel chamber 32. This is desirable if the fuel chamber is made of, for example, metal. Thus, the ignition wire 64 is prevented from short circuiting.

Figure 4C:
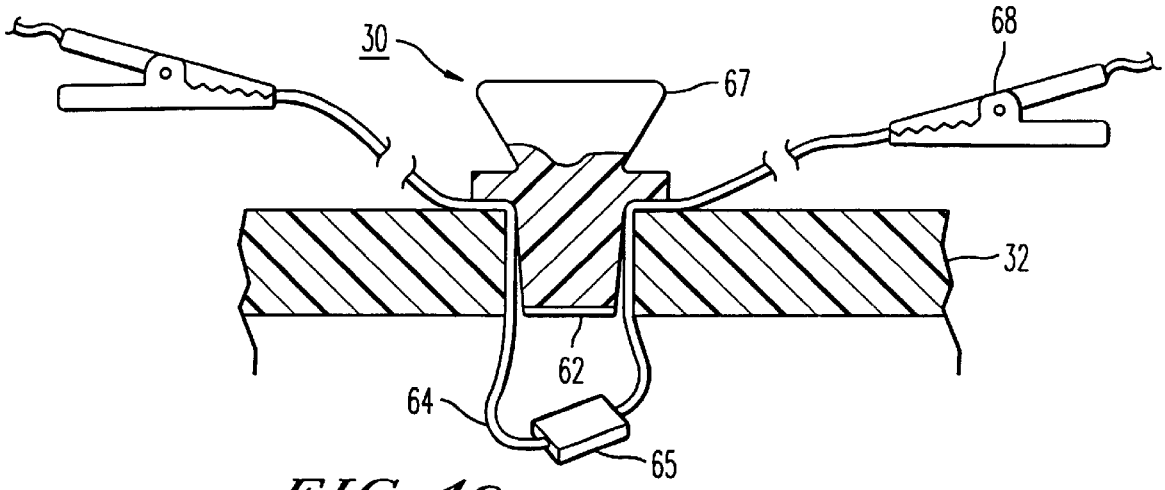
FIG. 4*c* is a fragmentary cross-section of another remote ignition device used to ignite the device illustrated in FIG. 1.

FIG. 4*c* shows an alternative way to secure the ignition wire 64. Instead of using a securing material 66 as shown in FIG. 4*b*, the ignition wire 64 may be secured using a ignition cap 67 which may be pressed into the ignition port 62. Alternatively, the ignition cap 67 may be threadedly engaged into the ignition port 62. The ignitor material 65 includes any material which when given an electrical charge will produce an appropriate spark. For example, a conventional ignition material which includes the ignition wire and securing cap may be purchased from ESTE model rockets.

An alternate method of igniting the device 20 may be performed using a barbecue lighter or lantern sparker such as one sold under the trademark COLEMAN. These are easily found in a sporting goods store with a camping section. The sparker or barbecue lighter is inserted into the ignition port 62 and ignited. The barbecue lighter can produce a sustained flame that allows for a more reliable combustion. Alternatively, a sparker device may require more than one spark before the fuel is ignited. The preferred safest method of igniting the device 20 is that described with reference to FIGS. 4*a*–4*c*, because the device 20 may be remotely ignited.

Figure 5:
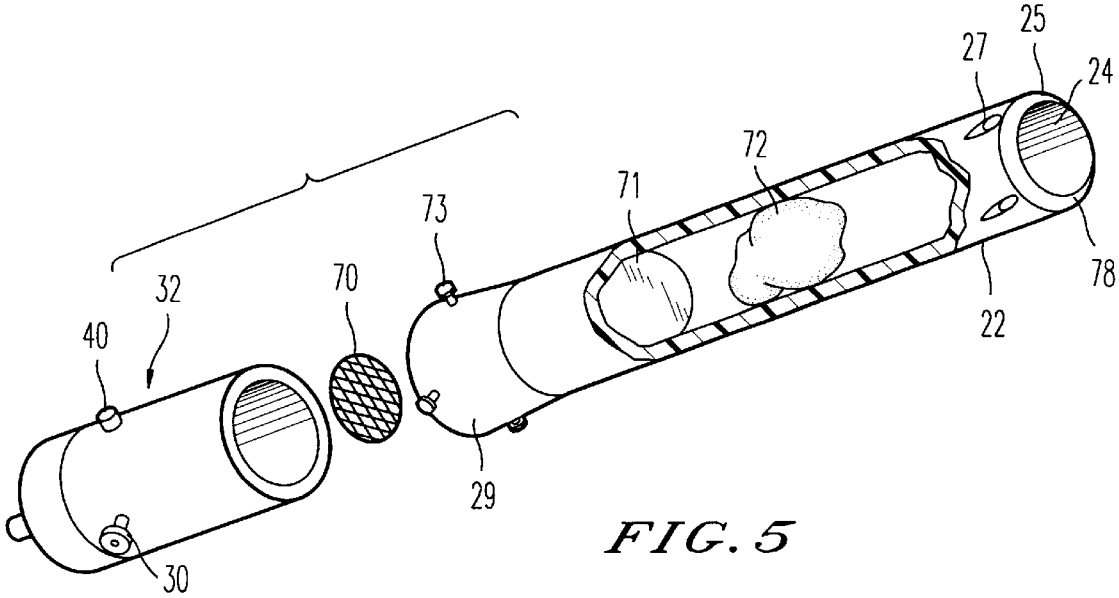
FIG. 5 is an exploded, partially cut away perspective view of the device illustrated in FIG. 1.

FIG. 5 is an exploded, partially cut away view of the propulsion device 20 shown in FIG. 1. As previously discussed, the barrel 22 has a longitudinal bore 24. Also shown is the fuel chamber 32 including the ignitor 30 and fuel nozzle actuator 40. A breech screen 70 is used to prevent an object 72, which is to be propelled, from falling into the fuel chamber 32. The breech screen 70 may be constructed of plastic or wire mesh. The object 72 is preferably a biodegradable object, such as a potato, tomato, etc, so that, after propulsion it is not necessary to retrieve the object. Additionally, biodegradable objects contain moisture and when their skin is broken or peeled away, provide a lubricating fluid (not shown) on the inside of the longitudinal bore 24 facilitating outward propulsion. Alternatively, other objects including rubber balls, compressible objects, etc., may be used and either placed on top of the object 72 or with a wadding 71. Furthermore, as an added security feature, safety bolts 73 may be added to joints of the device to provide additional structural integrity. The weakest part of the device is at the reducer 29 where the barrel 22 is joined to the fuel chamber 32. If over-stressed, the reducer 29 will be the first part to fracture at this joined area. Ends of the safety bolts 73 on an inside of the reducer 29 also act as a simple breech and may be used in lieu of the breech screen 70 to block the projectile from being pushed into the fuel chamber 32. The diameter of the fuel chamber 32 can be smaller, larger or the same diameter as that of the barrel 22. A larger diameter fuel chamber 32 may be selected to increase the amount of fuel 35 which may be injected to increase the velocity of the projectile. Likewise, the fuel chamber 32 can be smaller than that of the barrel 22 for propelling larger objects 72 at a lower velocity. In either case, an appropriate PVC or ABS reducer 29 will be required to connect the fuel chamber 32 to the barrel 22. For example, if the diameter of the fuel chamber 32 is 6 inches and the diameter of the barrel 22 is 3 inches, a 6 inch to 3 inch ABS or PVC reducer would be required. The length of the fuel chamber 32 is also widely variable. A length as short as 2 inches may be used with, for example, a interchangeable barrel 22 having a length of 1 foot. However, a length of 1 foot or more may be selected for the fuel chamber 32 to improve the firing power of the device. The fuel chamber 32 may be constructed using a standard ABS or PVC pipe, shortened to a desired length, and sealed with an ABS or PVC threaded end cap 31.

If the object 72 to be propelled is smaller than the diameter of the longitudinal bore 24, the wadding 71 may be used to provide a secure fit. The wadding 71 is preferably neoprene or cardboard cut to the diameter of the bore and is inserted before the object 72. Then, the object 72 may be inserted into the longitudinal bore 24 and pressed downwardly against the breech screen 70. The object 72 and wadding 71 may be inserted, using for example, a ramrod (e.g., a broom handle, golf club, etc.) with a measuring mark to push the object 72 to the optimum point above the breech screen 70. Thus, by using the wadding 71, an object having an unalterable irregular shape or one which is smaller than the diameter of the longitudinal bore 24 may be propelled.

Figure 6:
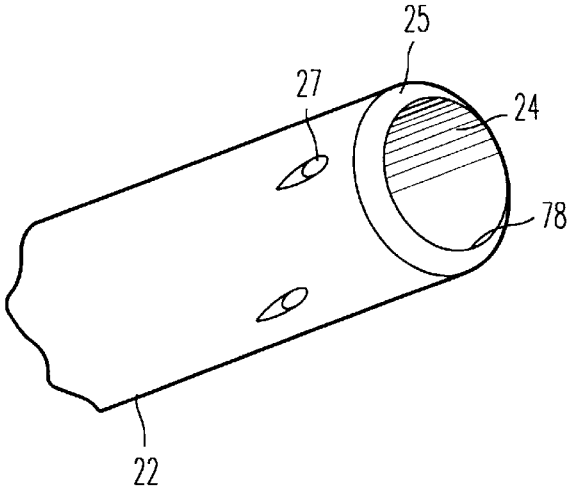
FIG. 6 is a partial perspective illustration of an end portion of a barrel of the device illustrated in FIG. 5.

FIG. 6 is a partial perspective illustration of the end portion of the barrel 22 of the device illustrated in FIG. 5. The end of the firing muzzle is preferably sharpened to create a beveled portion illustrated at 25, and to create a sharp trimming edge 78 designed to cut into and peel or trim the biodegradable object 72. Therefore, the object 72 fits snugly within the bore 24 of the barrel 22. In addition, the trimming edge 78 cuts the object 72 and releases fluids contained within it to lubricate the bore 24. Likewise, the snug fit creates an air tight seal with the bore 24 of the barrel 22 to minimize gas leakage and produce a maximum thrust. Alternatively, the trimming edge 78 may be notched having teeth pointing towards an apex resembling the serrated edge of knife. Noise reducing apertures 27 may be drilled at an angle on the barrel 22 and which slope towards the fuel chamber 32. This allows the propelling gas to expand slightly before exiting the barrel 22, thereby reducing the sound produced by the shockwave and resulting noise when the device is fired.

A method of operating the propulsion device 20 shown in FIG. 5 will now be described. First, the device may be set up as shown in FIG. 1, with the fuel chamber 32 resting on a hard surface, such as the firing platform 28. A biodegradable object 72 is twisted against the trimming edge 78 of the bore 24 and is trimmed as it is inserted into the bore 24. The twisting force accomplishes two things, first it creates a snug fit between the object 72 and the inside of the bore 24, and second it releases the natural juices of the object 72 which lubricate the inside of the bore 24. A ramrod (not shown) is then used to ram the object 72 so that it comes to rest above the breech screen 70 and/or the safety bolts 73. Then, fuel 35 from the fuel canister 36 is injected into the fuel chamber 32 through the fuel nozzle actuator 40. The fuel 35 does not escape because the biodegradable object 72 creates a tight seal on the inside of the bore 24. For firing to occur, a proper fuel and air mixture is needed for combustion. Typically, activation of the fuel nozzle 34 by the fuel nozzle actuator 40 for 3 to 5 seconds is generally sufficient to propel an object several hundred feet. Too little fuel 35 may not provide enough vapor to combust, while too much fuel 35 may not leave enough oxygen in the fuel chamber 32 for the fuel and air mixture to ignite. When inserting the fuel 35 into the fuel chamber 32, the fuel canister 36 should be positioned to not allow the heavier fuel 35 molecules (i.e., heavier than air molecules) to escape out of the fuel nozzle actuator 40. When an adequate amount of fuel 35 is dispensed into the fuel chamber 32, the device 20 may then be ignited using any of the ignitors 30 discussed above. The distance the object 72 is propelled depends on fuel allocation and the tightness of the seal of the object 72 trimmed and shaped by the trimming edge 78 of the barrel 22. After igniting the device 20, the object 72 is propelled upwardly and outwardly.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for propelling a biodegradable object, comprising:

a fuel chamber having a fuel inlet and an ignition port, the fuel inlet including a fuel nozzle actuator configured to press a fuel nozzle into a fuel canister to dispense fuel into the fuel chamber; and a barrel having a longitudinal bore, the barrel being connected to the fuel chamber.

2. The device according to claim 1, wherein the fuel nozzle actuator includes an L-shaped rigid member disposed on an inner surface of the fuel chamber and extended over the fuel inlet.

3. The device according to claim 1, wherein the fuel nozzle actuator includes a U-shaped rigid member disposed on an inner surface of the fuel chamber and extending over the fuel inlet.

4. The device according to claim 1, wherein the fuel nozzle actuator includes a mesh material extending over the fuel inlet.

5. The device according to claim 1, wherein the fuel nozzle actuator includes at least one hinged member bridging the fuel inlet.

6. The device according to claim 1, wherein the fuel inlet includes a fuel retainer covering the fuel inlet.

7. The device according to claim 1, wherein the ignition port includes a pull trigger ignition device disposed through the ignition port.

8. The device according to claim 1, wherein the fuel chamber and the barrel comprise a material including at least one of an ABS and a PVC material.

9. The device according to claim 1, wherein the barrel includes a plurality of noise reducing holes.

10. The device according to claim 1, wherein the barrel is beveled at its muzzle end to include a sharpened edge for trimming and peeling the biodegradable projectile.

11. The device according to claim 1, wherein the barrel includes a breech at one end of the longitudinal bore, and the fuel chamber is coupled to the barrel at the breech.

12. The device according to claim 1, further comprising safety screws coupling the fuel chamber to the barrel.

13. The device according to claim 12, wherein the breech includes a mesh screen.

14. The device according to claim 1, wherein the ignition port includes an ignition wire having ignition material attached thereto disposed through the ignition port into the fuel chamber.

15. The device according to claim 14, wherein the ignition wire is connected to a remote activation device for igniting the ignition material.

16. The device according to claim 14, wherein the ignition wire is secured in said ignition port.

17. The device according to claim 1, further comprising:

an adjustable support for elevating the barrel to a predetermined angle relative to a horizontal plane; and a base supporting the adjustable support.

18. A system for propelling an object, comprising:

a fuel chamber having an ignition port and a fuel inlet;

a barrel having a longitudinal bore connected to the fuel chamber;

means for pressing a fuel nozzle into a fuel canister to dispense fuel into the fuel chamber via the fuel inlet; and means for igniting the fuel dispensed into the fuel chamber.

19. A system according to claim 18, further comprising:

means for adjusting an angle of the barrel to a predetermined angle relative to a horizontal plane.

20. A system according to claim 18, wherein the means for igniting includes an ignition wire having an ignitable material, the ignition wire being disposed in the ignition port of the fuel chamber.

21. A system according to claim 20, further comprising:

means for securing the ignition wire into the ignition port of the fuel chamber.

22. A system according to claim 18, wherein the means for igniting includes a pull trigger ignition device disposed through said ignition port.

23. A system according to claim 18, wherein the means for receiving the fuel includes a mesh material covering the fuel inlet.

24. A system according to claim 18, wherein the means for receiving the fuel includes an L-shaped member disposed on an inner surface of the fuel chamber and extending over the fuel inlet.

25. A system according to claim 18, wherein the means for receiving the fuel includes a U-shaped member disposed on an inner surface of the fuel chamber and extending over the fuel inlet.

26. A system according to claim 18, wherein the means for receiving the fuel includes at least one hinged member bridging the fuel inlet.

27. A transportable device for propelling a biodegradable object, comprising:

a base;

a barrel having a bore;

a barrel support of adjustable length coupling said barrel to said base, said barrel including a sharpened end with a trimming edge for trimming said biodegradable object to fit closely into said bore and including noise dispersing apertures; and a fuel chamber secured to said barrel and including an ignition device and a fuel nozzle actuator.

wherein said fuel nozzle actuator is configured to press a fuel nozzle into a fuel canister to dispense fuel into the fuel chamber.

28. A method for operating a propulsion device, comprising the steps of:

pushing a biodegradable object down a barrel of the propulsion device with a ramrod;

pressing a fuel nozzle of a fuel canister against a fuel nozzle actuator included in a fuel chamber of the propulsion device to spray fuel into said fuel chamber; and activating an ignitor switch to combust said fuel sprayed into the fuel chamber so as to project the biodegradable object out of an open end of the barrel.

29. A device for propelling an object, comprising:

a fuel chamber having a fuel inlet and an ignition port, the fuel inlet including a fuel nozzle actuator configured to press a fuel nozzle into a fuel canister to dispense fuel into the fuel chamber; and a barrel having a longitudinal bore, the barrel being connected to the fuel chamber.

30. The device according to claim 29, wherein the fuel nozzle actuator includes an L-shaped rigid member disposed on an inner surface of the fuel chamber and extended over the fuel inlet.

31. The device according to claim 29, wherein the fuel nozzle actuator includes a U-shaped rigid member disposed on an inner surface of the fuel chamber and extending over the fuel inlet.

32. The device according to claim 29, wherein the fuel nozzle actuator includes a mesh material extending over the fuel inlet.

33. The device according to claim 29, wherein the fuel nozzle actuator includes at least one hinged member bridging the fuel inlet.

* * * * *